US005842612A

United States Patent [19]

Won

[11] Patent Number: 5,842,612

[45] Date of Patent: Dec. 1, 1998

[54] PLUGGING SYSTEM FOR LIQUID CONTAINER

[76] Inventor: Jea - Don Won, 19-902 Shindong-a Apt., Hak-ik 2-dong, Nam-gu, Inch'on, Rep. of Korea

[21] Appl. No.: 682,112

[22] Filed: Jul. 17, 1996

[51] Int. Cl.[6] ..... B67D 3/00

[52] U.S. Cl. ..... 222/509; 222/518

[58] Field of Search ..... 222/505, 507, 222/509, 518

[56] References Cited

U.S. PATENT DOCUMENTS

| | | | |
|---|---|---|---|
| 3,153,498 | 10/1964 | Bakker | 222/509 X |
| 4,676,411 | 6/1987 | Simaski | 222/509 X |
| 4,801,053 | 1/1989 | Kaster | 222/509 X |
| 5,037,015 | 8/1991 | Collins | 222/509 X |
| 5,105,960 | 4/1992 | Crisci et al. . | |
| 5,392,967 | 2/1995 | Satomi et al. | 222/509 |
| 5,435,470 | 7/1995 | Kim | 222/509 |
| 5,449,078 | 9/1995 | Akers . | |
| 5,465,876 | 11/1995 | Crisci . | |
| 5,495,966 | 3/1996 | Won | 222/518 X |
| 5,615,808 | 4/1997 | Huang | 222/509 X |

*Primary Examiner*—Kenneth Bomberg
*Attorney, Agent, or Firm*—Bryan Cave LLP

[57] ABSTRACT

A plugging system for a liquid container (31) comprises an inner plug (3) and an outer plug (1), an opening/closing member 8, and a pressure adjusting springs (9, 9') which apply elastic force to the opening/closing member (8) against the inner plug (3). A push button (131) is mounted in the center of the plugging system and has a rib (132) which is downwardly extended and coupled to the opening/closing member (8). In a closed state of the plugging system, a shoulder portion (135) of an opening/closing button (133) is caught by the rib (132). While in an opening state, as the opening closing button (133) is pushed outwardly, the rib (132) is pushed downwardly and a moving rail portion (134) slides on the rib (132) since the shoulder portion (135) is released from the rib (132) thereby opening the discharge path (4).

1 Claim, 5 Drawing Sheets

PLUGGING SYSTEM FOR LIQUID CONTAINER

BACKGROUND OF THE INVENTION

1. Field of the Invention

The present invention relates to a plugging system for a liquid container, and particularly to an improved plugging system for a liquid container by which a liquid contained within the container is discharged in the direction that the container is tilted when selectively pressing a button disposed at the plug, thus opening an opening port of the plug, and when closing the outer lid, a safety lid is automatically closed, thus preventing the liquid therewithin from being discharged from the container.

2. Description of the Prior Art

Conventionally, the lid or the plug of a liquid container tightly plugs the opening port of the liquid container so as to prevent the liquid from being discharged from the container. In addition, when discharging the liquid within the container, the lid or the plug is rotated and then separated from the container.

However, the conventional lid or plug of the container is inconvenient to use. That is, the lid or plug is manually rotated with a predetermined force. When not in use, the lid or plug should be engaged thereto again so as to prevent the liquid within the container from being discharged therefrom and maintain the temperature of the liquid from being cooled.

Meanwhile, a system having a liquid discharging hole, formed at a periphery of the neck of the container, through which the liquid within the container is discharged after unfastening the lid of plug at a predetermined angle was disclosed in the industry. However, this system has disadvantage in that the liquid within the container is not effectively discharged when unfastening the lid or plug without confirming the direction of the liquid discharging hole.

In addition, when using the liquid contained in the container, the plug is twisted and then is separated from the container, so it is very inconvenient to use. When the user closes the outer plug without engaging the inner plug, the heat of the stuff of the container is not kept. In addition, the liquid contained in the container may be discharged.

Since the above-mentioned system is directed to the lid- or plug-rotating type, a user should manually rotate the lid or plug for the use of the liquid contained within the container or unfasten the same so as to keep the heat of the liquid within the container or to prevent the liquid therewithin from being discharged therefrom.

SUMMARY OF THE INVENTION

Accordingly, it is an object of the present invention to provide a plugging system for a liquid container, which overcomes the problems encountered in a conventional plugging system for a liquid container.

It is another object of the present invention to provide an improved plugging system for a liquid container by which a liquid contained within the container is discharged in the direction that the container is tilted when selectively pressing a button disposed at a plug, thus opening an opening port of the plug.

To achieve the above objects, there is provided a plugging system for a liquid container of the present invention, which includes an outer plug having a threaded portion formed at an outer portion of the same and threadedly engaged to an outer neck portion of a liquid container and having an opened lower portion; an inner plug spatially inserted into the interior of the outer plug; a discharging path spatially formed between the outer plug and the inner plug; an opening/closing member, which is movable within the inner plug, having a lead formed at the lower portion of the same and the upper portion of which is extended within the inner plug; one or more pressure adjusting springs for elastically supporting the opening/closing member with respect to the inner plug so that the lead of the opening/closing member is positioned at a predetermined position where the lower opening of the outer plug is substantially closed; a movable member hinged to the inner plug and contacting with the upper portion of the opening/closing member; a protrusion hinged to the inner plug, and coming into contact with the upper portion of the opening/closing member, and formed at the lower portion of the movable member for downwardly pressing the upper portion of the opening/closing member when the movable member becomes movable; a pair of push buttons disposed at the upper portion of the inner plug; and a lid for permitting the opening/closing member to close the opening in a state that the lid is engaged to the push button which is upwardly protruded from the upper portion of the liquid container.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
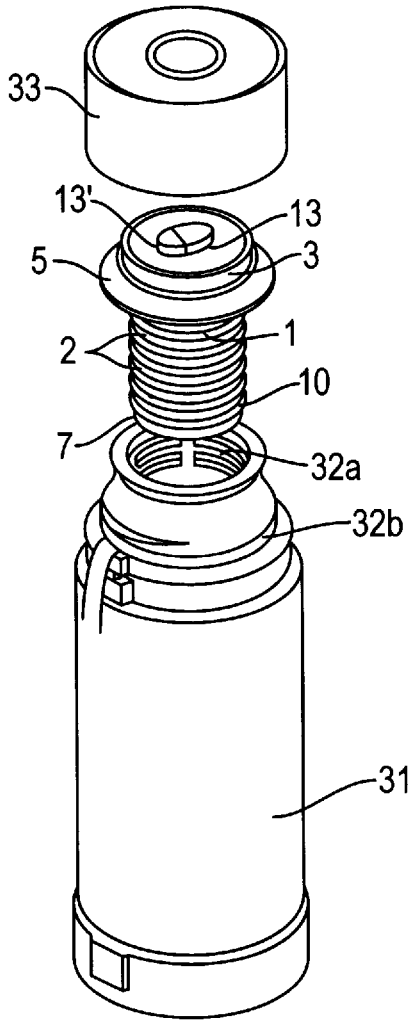
FIG. 1 is a perspective view showing a disassembled liquid container including a container, a plug, and a lid according to the present invention.
Figure 2:
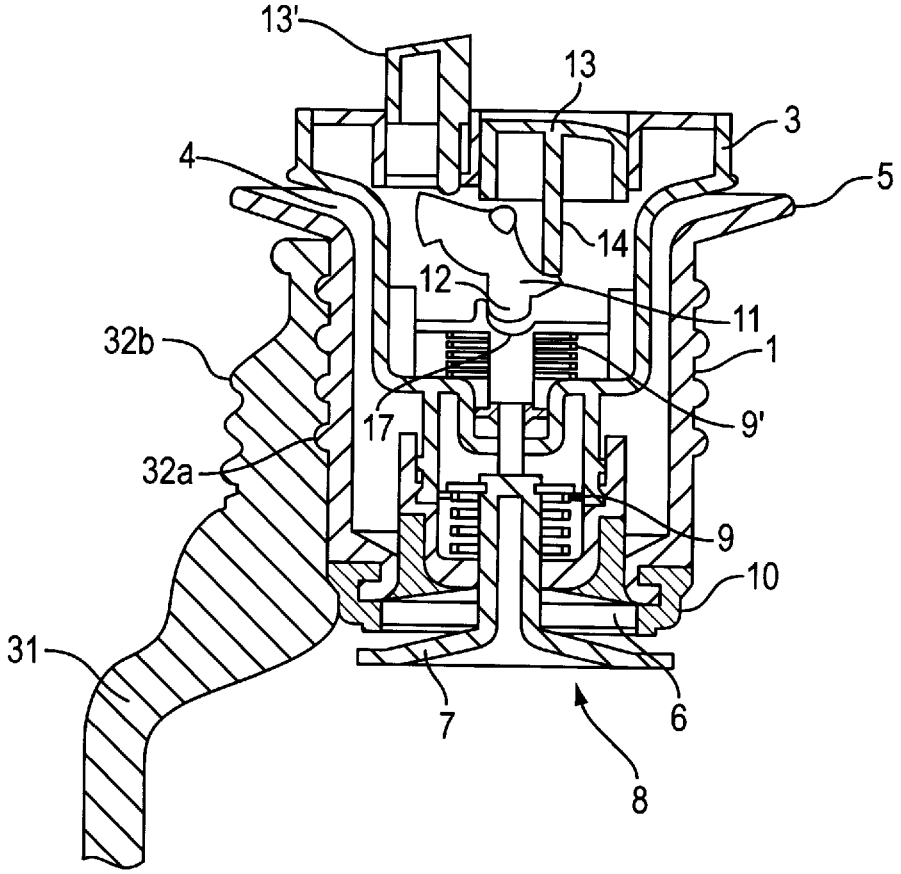
FIG. 2 is a cross-sectional view of a plugging system for a liquid container of which an opening port of the plug is opened by pressing a push button of the present invention.

FIGS. 1 and 2 show the construction of a plugging system for a liquid container of the present invention, which includes a threaded portion 32*a* formed at an inner surface of the neck portion of a liquid container 31. A threaded portion 32*b* is formed at an outer portion of the neck portion of the liquid container 31.

A plurality of threads are formed at an outer portion of an outer plug 1. An inner plug 3 is spatially inserted into the outer plug 1. The upper and lower portions of the outer plug are opened. A discharging path 4 is formed between the outer plug 1 and the inner plug 3. An outwardly protruded rim 5 is formed at the upper portion of the outer plug 1, and the liquid contained within the liquid container 31 is discharged through an opening 6 formed at the lower portion of the outer plug 1 and the discharging path 4. Meanwhile, a lead 7 is formed for opening/closing the opening 6 formed at the lower portion of the outer plug 1, and an opening/closing member 8 having the lead 7 formed at its lower end is reciprocated within the inner plug 3. Here, pressure adjusting springs 9 and 9' are disposed at a predetermined portion, respectively, for elastically supporting the opening/closing member 8 with respect to the inner plug 3 so that the opening/closing member 8 can be positioned at a predetermined portion where the opening 6 is substantially opened/closed. A sealing member 10 is disposed between the lower portion of the outer plug 1 and the opening/closing member 8. Meanwhile, a fan-shaped movable member 11 which comes into contact with the upper portion of the opening/closing member 8 received within the inner plug 3 and is movable at a predetermined angle is hinged to the inner plug 3. An outwardly extended protrusion 12 is formed at a predetermined portion with which the upper portion of the opening/closing member 8 of the movable member 11 comes into contact. Meanwhile, two push buttons 13 and 13' are disposed at the upper portion of the inner plug 3 which is extended from the upper portion of the outer plug 1, and operating rods 14 and 14' of the push buttons 13 and 13' are downwardly extended and then connected to both ends of the movable member 11.

Preferably, an engaging jaw portion 15 may be formed at a predetermined portion with which the upper portion of the opening/closing member 8 of the movable member 11 comes into contact, and a protrusion 16 to which the engaging jaw portion 15 is engaged is formed at the upper portion of the opening/closing member 8.

In addition, a groove 17 is preferably formed at the upper center portion of the opening/closing member 8, and the protrusion 12 of the movable member 11 is substantially received within the groove 17.

A roller or the like may be disposed at the protrusion 12 of the movable member 11, so that the push buttons 13 and 13' can be easily and smoothly pushed and released.

Since the outer plug 1 which is threadedly inserted into the liquid container 31 is outwardly exposed to the outside, and the opening portion of the discharging path 4 formed between the inner plug 3 and the outer plug 1 is exposed to the outside, a threaded portion 33*a*, formed in lid 33, which is threadedly engaged with the threaded portion 32*b* of the liquid container 31, is formed at the inner side, and a fastening jaw portion 34, formed in lid 33, with which the opening of the liquid container comes into contact is formed at the inner upper portion of lid 33. The lid 33 is disposed for substantially covering the upper portion of the liquid container 31. The inner upper portion 35 of the lid 33 is preferably disposed at the upper portion of the inner plug 3, namely, at a periphery of the push button 13.

The operation of the plugging system for a liquid container will now be described with reference to the accompanying drawings.

FIG. 2 shows the partial upper portion of the plugging system for a liquid container of the present invention. As shown therein, the inner plug 3 is inserted into the opening of the liquid container 31, and then the threaded portion 32*a* and the threaded portion 2 are threadedly engaged with each other.

At the initial stage, since the opening/closing member 8 closes the opening 6, the liquid within the liquid container 31 is not discharged to the outside of the same.

When pushing one of two push buttons 13 formed at the upper portion of the inner plug 3, the operating rod 14 of the push button 13 causes the movable member 11 to move, and the protrusion 12 formed at the lower portion of the movable member 11 downwardly presses the upper portion of the opening/closing member 8 beyond the elastic force of the pressure adjusting spring. As a result, the lead 7 formed at the lower portion of the opening/closing member opens the opening 6 formed at the lower portion of the outer plug 1, whereby the liquid within the liquid container 31 is discharged to the outside in the direction that the container 31 is tilted when tilting the container 31.

Here, since the discharging path 4 formed between the outer plug 1 and the inner plug 3 is circular-shaped, when tilting the liquid container 31 in any direction, the liquid is discharged in a predetermined direction irrespective of the tilting direction of the liquid container. So, it is not necessary to confirm the liquid discharging direction as compared to the prior art.

In addition, when pushing the other button of the two buttons 13, the movable member 11 is rotated in the reversed direction in cooperation with the operation rod of the push rod until the engaging jaw portion 15 is substantially engaged to the protrusion 16 formed at the upper portion of the opening/closing member 8. At this time, the opening/closing member 8 is returned to the original position in cooperation with the pressure adjusting spring. As a result, since the lead 7 of the opening/closing member 8 closes the opening 6 of the outer plug 1, the liquid contained within the liquid container is not discharged to the outside.

Figure 3A:
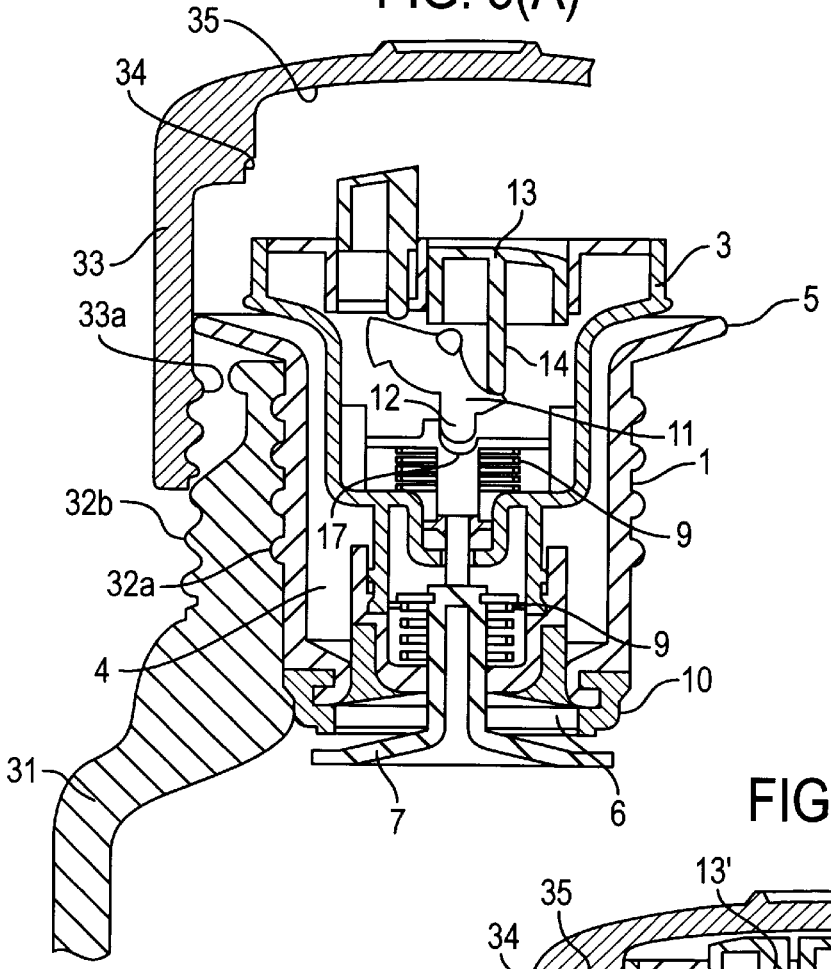
FIGS. 3A and 3B are cross-sectional views of a plugging system for a liquid container of which an opening port of the plug is closed by pressing a push button and then by engaging the lid to the container plug according to the present invention.
Figure 3B:
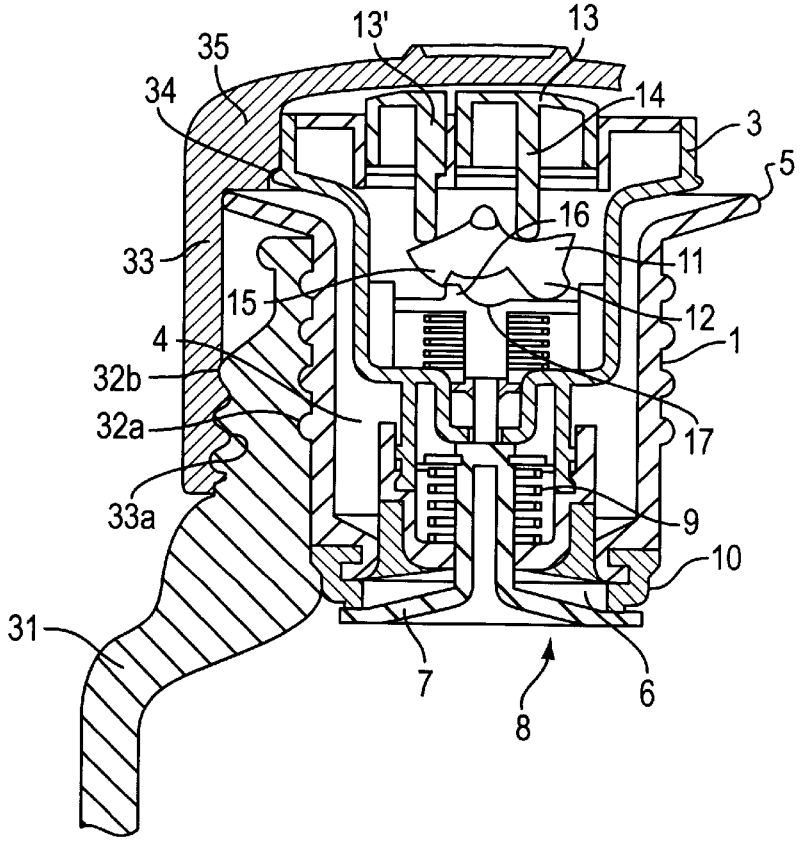
Figure 4:
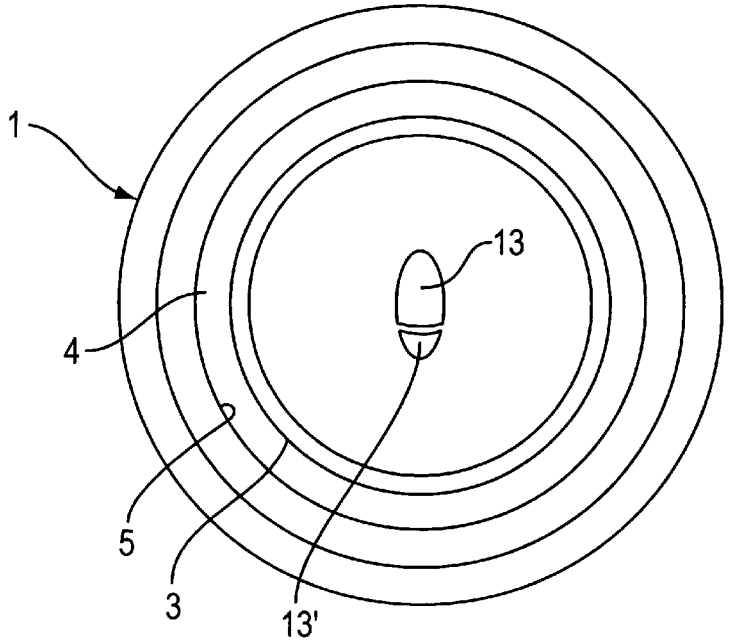
FIG. 4 is a top view of a plugging system for a liquid container of which a plug is engaged to the liquid container.

In addition, when a user forgot that the push button 13 is pushed and then the opening 6 of the outer plug 1 is opened, the liquid contained within the liquid container 31 may be discharged to the outside. However, since the lid 33 is engaged to the upper portion of the liquid container 31, thus engaging the threaded portion 32*a* and the threaded portion 32 of the container, the engaging jaw portion 34 formed at the inner upper portion of the lid 33 comes into contact with the opening of the outer plug 1, and the inner upper portion 35 comes into contact with the button 14 which is upwardly protruded from the plug as shown in FIG. 3A, so that the protruded push button 14 is returned to the original position in cooperation with the lid 33, and thus the lead 7 of the opening/closing member 8 comes into tight contact with the opening 6, the discharging path 4 is blocked.

Figure 5:
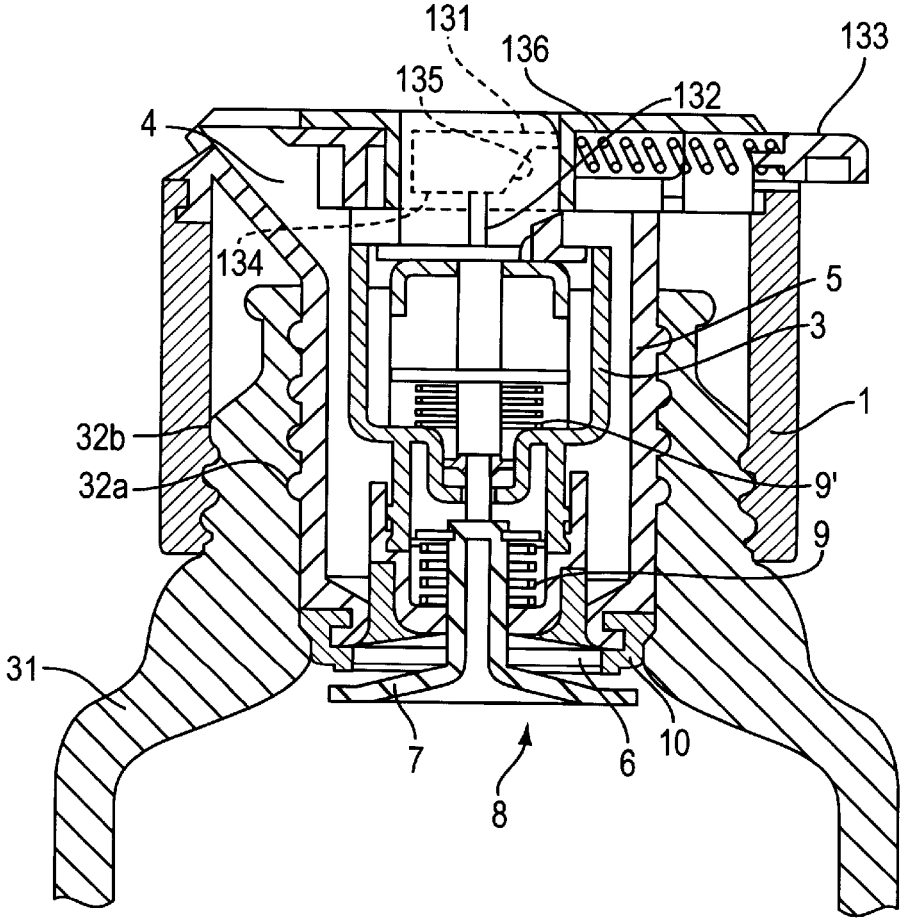
FIG. 5 is a cross-sectional view showing a plugging system for a liquid container according to another embodiment of the present invention.
Figure 6:
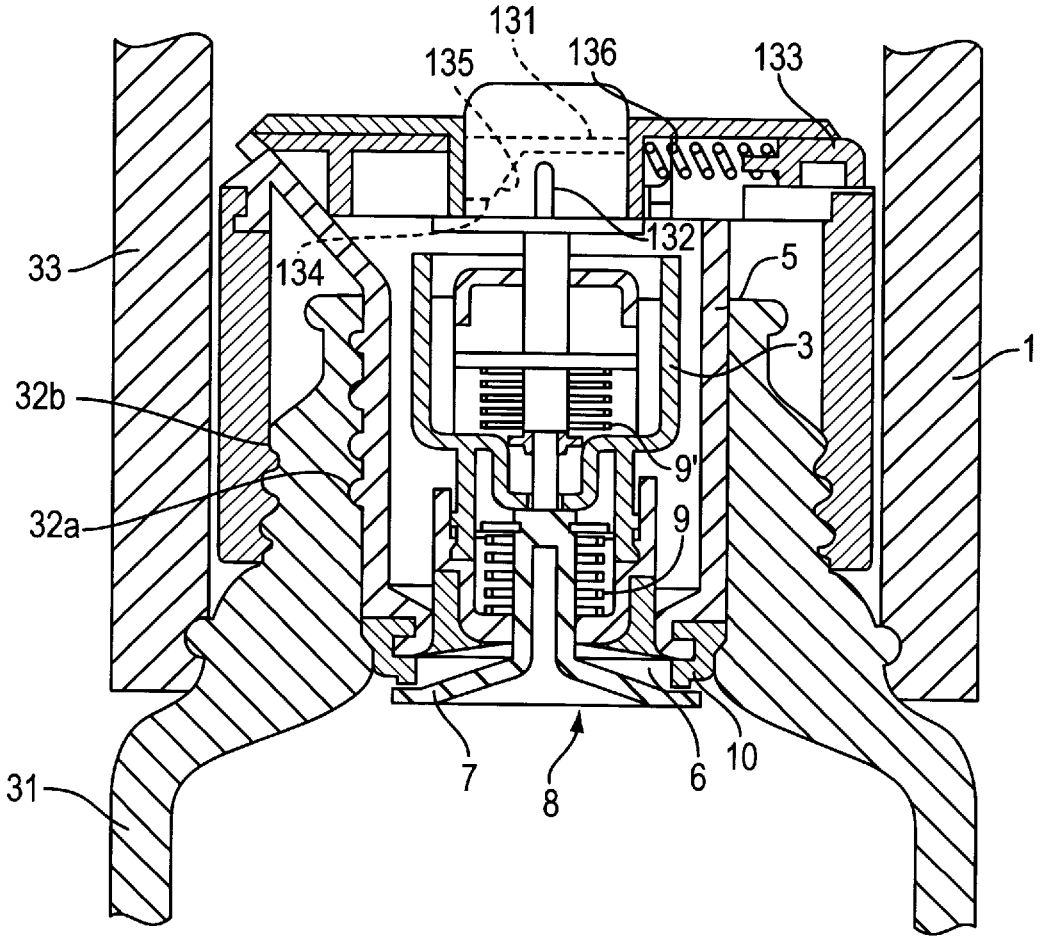
FIG. 6 is a cross-sectional view showing an operation state of a plugging system for a liquid container according to the present invention.

FIGS. 5 and 6 shows a plugging system for a liquid container according to another embodiment of the present invention.

As shown therein, an opening port 133 and a button 131 are disposed at the upper center portion of the plug, so that an engaging rib 132 on the button 131 enables the opening port 133 to horizontally slide due to a spring 136 when the button 131 is pushed, thus allowing a rail portion 134 to bear against the rib 132 thereby opening a discharging path. When lid 33 is closed, the inner portion of the lid pushes the opening port 133 in order for the discharging path to be closed. In the closed state, a shoulder portion 135 on opening port 133 engages rib 132 to maintain opening port 133 in a closed state. Therefore, when closing the lid 33 without closing the discharging path, the plug can be automatically closed.

As described above, the plugging system for a liquid container is directed to preventing the liquid contained within the liquid container from being discharged therefrom by blocking the discharging path in a state that the lid is just engaged to the container. Since the plug of the present invention serves to discharge and block the liquid within the container in one touch method, it is very convenient to use the liquid container. In addition, it is not necessary to unfasten or fasten the plug so as to use the liquid contained within the container, so the temperature of the liquid within the container can be effectively preserved when the plugging system is used for the thermos bottle or the like.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A plugging system for a liquid container having a removable lid comprising:

an outer plug having a threaded portion formed at an inner portion of the same and threadedly engaged to an outer neck portion of a liquid container, said outer plug comprising a lower portion having an opening therein for discharging liquid contained within said liquid container;

an inner plug spatially inserted into an interior of the outer plug;

a discharging path for said liquid, said discharging path being spatially formed between the outer plug and the inner plug;

an opening/closing member, which is movable within the inner plug, having a lead formed at a lower portion of the same and an upper portion of which is extended within the inner plug;

a pressure adjusting spring means for elastically supporting the opening/closing member with respect to the inner plug so that the lead of the opening/closing member is positioned at a predetermined position where the lower opening of the outer plug is substantially closed;

an engaging rib and an operating rail disposed at an upper center portion of the outer plug;

a slidable opening port elastically supported by a spring; and a button comprising said engaging rib said button being coupled to said opening port for enabling the discharging path to be closed by the opening port in accordance with a closing operation of the lid disposed at the upper portion of the outer plug and for enabling the discharging path to be opened by the opening port in accordance with operation of the button.

* * * * *